US007097879B2

(12) United States Patent
Bolton et al.

(10) Patent No.: US 7,097,879 B2
(45) **Date of Patent: *Aug. 29, 2006**

(54) WOOD GRAINING PROCESS

(75) Inventors: James A. Bolton, Shelton, CT (US); Timothy J. Bolton, Stratford, CT (US); Louis R. Zayas, Stratford, CT (US)

(73) Assignee: Grafted Coatings, Inc., Seymour, CT (US)

( * ) Notice: Subject to any disclaimer, the term of this patent is extended or adjusted under 35 U.S.C. 154(b) by 170 days.

This patent is subject to a terminal disclaimer.

(21) Appl. No.: 10/657,612

(22) Filed: Sep. 8, 2003

(65) Prior Publication Data

US 2004/0115350 A1 Jun. 17, 2004

Related U.S. Application Data

(60) Provisional application No. 60/408,573, filed on Sep. 6, 2002.

(51) Int. Cl.
*B05D 1/38* (2006.01)

(52) U.S. Cl. ..... 427/264; 427/261; 427/262; 427/358

(58) Field of Classification Search ..... 427/258, 427/260–262, 264, 267
See application file for complete search history.

(56) References Cited

U.S. PATENT DOCUMENTS 3,936,541 A * 2/1976 Plowman et al. ..... 427/262
5,534,352 A * 7/1996 Pittman et al. ..... 428/535
6,201,057 B1 * 3/2001 Porter ..... 524/501

* cited by examiner

*Primary Examiner*—Fred J. Parker
(74) *Attorney, Agent, or Firm*—Thaddius J. Carvis

(57) ABSTRACT

A kit and a process for using it to impart wood grain appearances are provided. According to the method, an opaque, pigmented, water-based paint/stain emulsion is applied to a wood-grain textured substrate and dried. Then, a pigmented, water-based graining coat water-based graining coat (most preferably a self-crosslinked urethane/acrylic) is applied sparingly, preferably by spraying from a small bottle, in an amount sufficient to color at least a majority of texture recesses in the substrate and drying. According to the kit aspect of the invention, the kit will comprise: an opaque, pigmented, water-based paint/stain emulsion; a pigmented, water-based graining coat emulsion, packaged in a spray bottle. Optionally, the kit can include a surface cleaner, a scraper, brush and/or cloth.

1 Claim, 2 Drawing Sheets

WOOD GRAINING PROCESS

PRIORITY

This application claims priority to U.S. Provisional Patent Application No. 60/408,573, filed Sep. 6, 2002, which is incorporated herein by reference in its entirety.

BACKGROUND OF THE INVENTION

The invention relates to a new process and a new kit for applying a natural appearing wood grain to a door, window or other item or component made of any suitable material having a wood grain texture.

In U.S. Pat. No. 5,075,059, Green describes a method which includes a first step of compression molding fiber reinforced polyester door skins with closed areas dense with deep grains, open areas with a generally lesser concentration of deep grains and reduced depth grains adjacent steeply angled trim areas. The open areas have a predetermined roughness, which is provided by the mold half used in compression molding. In the subsequent steps, the molded door skin is sprayed with a mixture of artist's oil cut 1:1 with mineral spirits on a fluid ounce basis. After twenty minutes, the sprayed mixture is rubbed into the external surface, and the door skin is then placed vertically in a forced air oven for about one hour at about 120° F. As a final step, a standard urethane top coat may be applied to the dried stain finish. By providing deep grains of varying density over most of the door skin surface, but reduced grain depths adjacent to steeply embossed or bossed trim sections, the external surfaces of the panel door are said to more realistically simulate a wood grain appearance, while the reduced depth of the grains in steeply angled areas minimizes risk of deformation during mold release.

The prior art that relies upon the use of a transparent or translucent stain as a first coat requires the user to have a good sense of color selection and matching. This need is exaggerated by the fact that different manufacturers of doors and other trim parts provide their own substrate base colors. Even though two pieces might seem to be the same "white" color, they are often different in the way that they receive the stain. This makes it difficult for a homeowner to properly match colors. Also, distinctly different base colors will cause distinctly different stained colors.

In U.S. Pat. No. 5,534,352 to Pittman, et al., describe a process for pre-finishing wood composite panels and/or structures having flat and contoured surfaces to result in a structure exhibiting the appearance of natural hard wood. The process includes a number of steps designed to facilitate industrial scale, machine production. To that end, they employ a ground coat in a first step, then a non-adherent "dry buffing glaze" which is selectively removed, and finally they apply a sealer to retain the remaining buffing glaze in textured ticks of the substrate. The dry buffing glaze is preferably a waterborne coating, applied to the substrate as a liquid and then flash dried to yield a dull powdery appearance. The true color of the glaze is not evident until it is wetted in a subsequent toning or top-coating step. The glaze has a high proportion (e.g. at least about 80 wt. %) of inert pigments so as to make it powdery and easily buffed from flat surfaces of the substrate.

The Pittman, et al., patent makes it clear that the product is not complete following the pre-finishing process, but is further prepared and finished or semi-finished. To emphasize that the process requires machine operation, they emphasize that, if the substrate were hand-rubbed during this step, the pressure of a glazing cloth could wipe the glaze out of the wood grain ticks—yielding a less realistic appearance. Following the buffing operation, a sealer is applied to bind the dry buffing glaze to the substrate and protect the panel finish during storage, shipping, and handling of the pre-finished substrate. The clear sealer, preferably a clear acrylic sealer, is sprayed on the substrate. The clear sealer also renders the substrate receptive to lacquer or solvent-based glazes and toners that may be applied to the substrate as a final finishing step.

One commercial form of wood graining kit, available from Pease Industries, Inc., of Fairfield, Ohio, is a solvent-based system comprising a wood stain and a clear topcoat. The literature on using the kit states that the stain is applied on a door using a lint-free cloth in a circular motion, working the stain into the embossed grain pattern. Next, a stain cloth is used to smooth the stain in the direction of the grain. The directions specifically say that excess stain should not be wiped off. Working the same area with a clean soft bristle brush to gently feather-out any streaks or lap marks follows this. If the stain color is not satisfactory, the stain can be cleaned off with mineral spirits before it dries, and applied again. If the first coat is too light, the literature suggests waiting 48 hours before a second coat is applied in the manner of the first coat. To complete the job, a Polyurethane topcoat is then applied. The stain must be thoroughly dry before top-coating—48 to 72 hours drying time is recommended.

Another type of commercial graining kit has been available with an opaque stain as one coat and a dark graining coat. The opaque coat would uniformly cover the surface being worked on and allowed to dry. Then, the dark graining coat would be applied with a brush or the like to paint on a grain pattern. Thus, the graining depended upon the artistic ability of the person doing the work.

In an attempt to directly coat synthetic molded doors, which are generally nonporous, U.S. Pat. No. 6,358,614 to Porter describes a weatherable coating based on a stain/topcoat system. The coating comprises a pigmented stain having substantially a single binder resin, which promotes adherence of a topcoat and a topcoat that is an aqueous dispersion of a film forming polymer and a curable organopolysiloxane microemulsion. The topcoat is said to display exceptional adhesion and weatherability to surfaces stained with the specially formulated pigmented stain. U.S. Pat. No. 6,120,852 and U.S. Pat. No. 5,948,849 are directly related.

The Porter coating is applied in two steps: a specially formulated pigmented stain coating and a compatible transparent topcoat. The stain is a solvent-based composition containing from 20 to 40% of a volatile solvent such as slowly evaporating solvents and solvents that exhibit fast to moderate evaporation, such as mineral spirits, naphtha, petroleum distillate, and the like. The topcoat is aqueous and includes from 25 to 55% of a water-dispersible non-polysiloxane film-forming polymer, 2 to 25% of a curable organopolysiloxane in the form of an emulsion and water superficial to the pigmented stain coating. The use of the curable organopolysiloxane emulsion is said to be necessary to make the topcoat compatible with the specially formulated stain. The use of solvents is, of course, less than desired, and the stain coat can provide a less than complete color treatment that must be preserved with a topcoat.

The Porter stain is applied directly to a non-porous thermoset and/or thermoplastic composite by conventional means, i.e., by brushing, spraying, sponging, rolling, wiping, and the like. The stain is specially formulated for these nonporous surfaces and excess stain is removed by wiping with a clean lint free rag, a china bristle brush or the like. The stain is generally allowed to dry for approximately 48 hours at room temperature under dry conditions. After the stain is dry, the topcoat is applied, preferably as two layers, with a total dry thickness of 10–100 μm. The topcoat is preferably with three hours between coats.

There remains a need for a process and a kit useful for imparting a wood-grained appearance to a wood-grain-textured substrate. There is particular need for a simple method and means for imparting a realistic, durable wood-grain appearance to molded doors, windows and other wood-simulating panels, composites or components, which have one or more surfaces textured to simulate the regular grain patterns of ticks associated with any of a variety of types of wood.

SUMMARY OF THE INVENTION

It is an objective of this invention to provide a new process and a new kit for applying a natural appearing wood grain to a door, window or other item or component made of any suitable material having a wood grain texture.

It is an objective of the invention to develop proper color foundation for the system:

- over any color door skin (some door skins are green, white, gray, etc.) and we are able to control the final color by painting the door to establish the background stain color over any color embossed substrate;
- complimentary coloration;
- well defined method for color reproducibility that does not rely on the supplied color of the door, itself;
- necessary to establish the natural color of the wood species selected or desired by the user (oak, pine, cherry, etc.).

It is another objective of the invention to provide a kit and a process for using it to impart wood grain appearances which not only appears easy, but is in fact easy for typical homeowner use.

It is another objective of the invention to provide a kit and a process for using it to impart wood grain appearances which provides professional-appearing results in two easy steps.

It is another objective of the invention to provide a kit and a process for using it to impart wood grain appearances which provides professional-appearing results in a very short application time.

It is another objective of the invention to provide a kit and a process for using it to impart wood grain appearances with low application rates and low cost in terms of materials and labor.

It is yet another objective of the invention to provide a kit and a process for using it to impart wood grain appearances to wood-textured surfaces having a durability similar to finished natural wood.

It is a still further objective of preferred forms of the invention to provide a kit and a process for using it to impart wood grain appearances to wood-textured surfaces having a glossy surface that appears similar to finished natural wood initially and maintains gloss for extended periods of exposure to sun and weather.

These and other objectives are achieved by the present invention, which provides a kit and a process for using it to impart wood grain appearances the method of the invention comprises: applying a base coat comprised of an opaque, pigmented, water-based paint/stain emulsion, to a wood-grain textured substrate and drying the base coat; and, then, sparingly applying a pigmented, water-based graining coat (most preferably a self-crosslinked urethane/acrylic) in an amount sufficient to color at least a majority of texture recesses in the substrate, and drying the applied coating.

According to the kit aspect of the invention, the kit will comprise: an opaque, pigmented, water-based paint/stain emulsion; a pigmented, water-based graining coat emulsion packaged in a spray bottle. Surprisingly, a 32 square foot paneled door can be grained with only about 1.5 to 3.0 ounces of graining coat stain. A brush and/or cloth are optional components. In a less preferred form, the kit can utilize a conventionally packaged graining coat stain and utilize the brush or a cloth, and a scraper to apply the graining coat.

A number of preferred aspects of the invention will be described below.

BRIEF DESCRIPTION OF THE DRAWINGS

The invention will be better understood and its advantages will become more apparent when the following detailed description is read in light of the accompanying drawings, wherein.

DETAILED DESCRIPTION OF THE INVENTION

The process and kit of the invention have particular advantage in applying a wood-grained appearance to a grain-textured substrate. The invention has particular advantage for imparting a realistic wood-grain appearance to molded doors, windows, trim and other wood-simulating panels, composites or components, which have one or more surfaces textured to simulate the regular grain patterns of ticks associated with any of a variety of types of wood.

Figure 1:
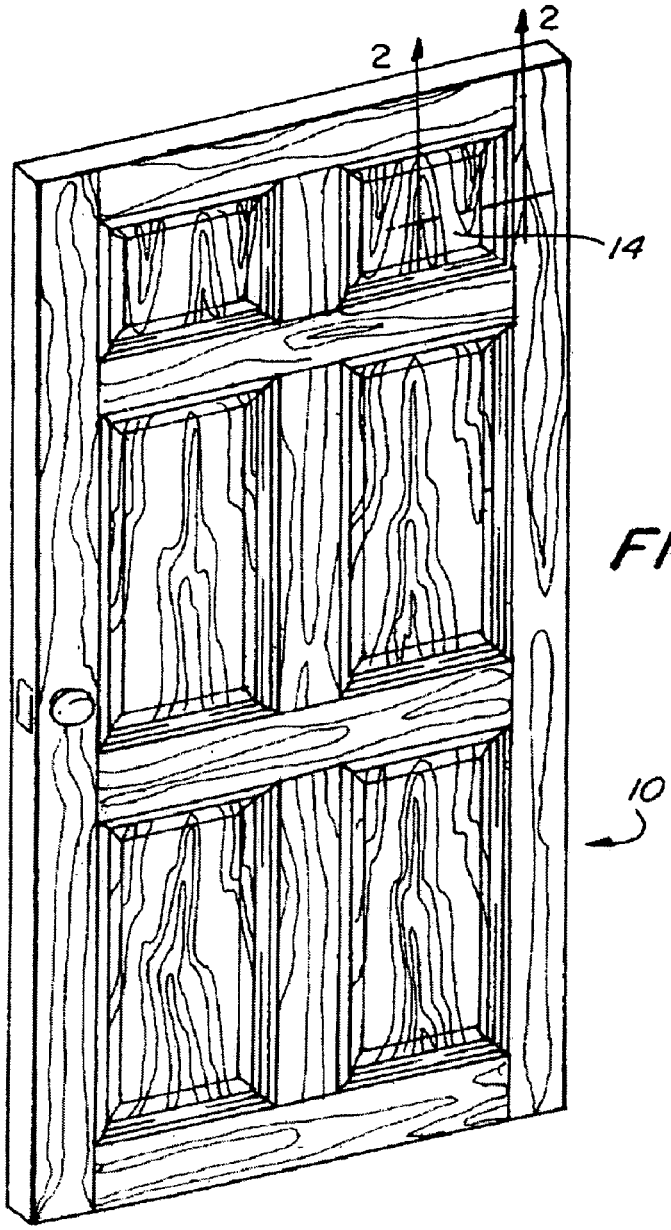
FIG. 1 is a perspective view of a six-paneled, wood-textured door of the type that can be given a wood grain in accord with the invention.

FIG. 1 shows a substrate of the type that can be treated according to the invention. The door 10 can be a molded door of the types available, for example, from Masonite Corporation and as illustrated and/or described in the above cited U.S. Pat. No. 5,075,059 to Green, U.S. Pat. No. 5,534,352 to Pittman, et al., and U.S. Pat. No. 6,358,614, to Porter. These patents are incorporated by reference for their descriptions of suitable wood-grained substrates. Fiberglass and carbon doors and windows available from available from Pease Industries, Inc., of Fairfield, Ohio, under the trademark Ever-Strait® also provide suitable wood grain textured substrates. The substrate can be a wood composite, of all wood or of a suitable molded polymer, either thermoplastic or thermosetting, preferably containing a suitable filler. Also of use are metal substrates and those based on cementitious or gypsum-based materials. In some cases, the grained surface is primed and in some cases priming is unnecessary. Indeed, there is no known limitation on the material or method of manufacture of the substrate.

Figure 2:
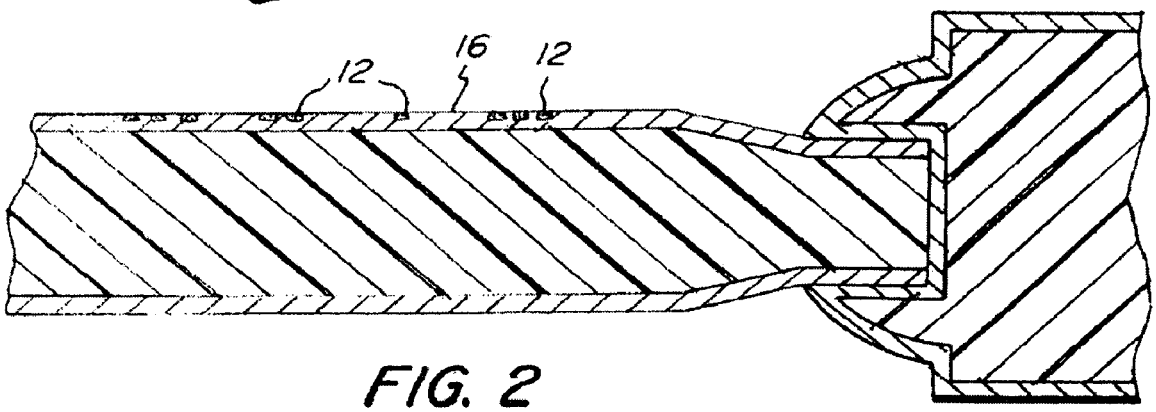
FIG. 2 is a sectional view, taken across line 2—2 in FIG. 1, showing the textured top surface of a section of the door illustrated in FIG. 1.

The wood-grain texture in the door 10 is provided by molded or formed recesses, known as ticks, shown generally as 12 in the detail of FIG. 2. The ticks 12 are arranged in a suitable grain-like pattern, shown generally as 14 in a surface 16 that is raised above the ticks, to provide a wood-like grain texture. The coating kit and the process of the invention will impart wood grain appearances which make substrates of the type described appear essentially the same as a well-finished natural wood door. According to the method of the invention an opaque, pigmented, water-based basecoat is applied to any suitable wood-grain textured substrate and dried. Then, a pigmented, water-based graining coat is applied sparingly in an amount sufficient to color at least a majority of texture recesses (i.e., ticks 12) in the substrate and dried.

Figure 3:
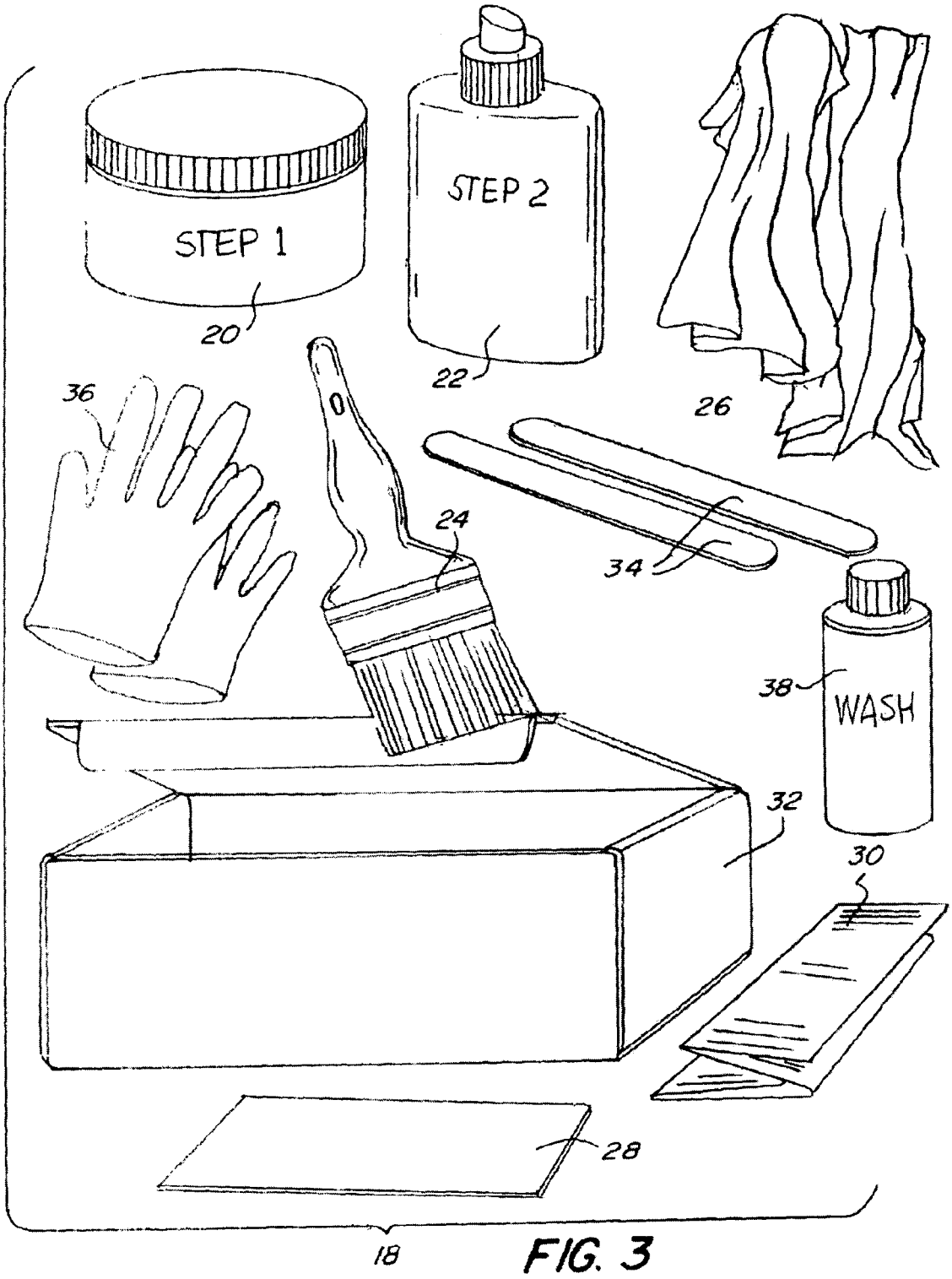
FIG. 3 is a schematic view showing the component parts of one embodiment of a kit according to the invention.

According to the kit aspect of the invention, the kit 18 will comprise as shown in FIG. 3: an opaque, pigmented, water-based base coat, which is applied to a wood-grain textured substrate—referred to herein as Step #1 coat 20, and a pigmented, water-based graining coat emulsion—referred to herein as Step #2 coat packaged in a spray bottle 22. Surprisingly, a 32 square foot paneled door can be grained with only about 1.5 to 3.0 ounces of graining coat stain. A brush 24 and/or cloth 26 are optional components. In a less preferred form, the kit can utilize a canned, bottled or otherwise conventionally packaged graining coat stain and utilize the brush 24 or a cloth 26, and a scraper 28 to apply and/or remove the graining coat. An instruction sheet, shown in more detail in FIG. 4, is shown as 30. All can be packaged together in box or the like 32

The preferred manner of applying the "Step #1" coat is to spray or brush it on in the same manner as any quality paint is referred to herein as a base coat and comprises a paint/stain emulsion. By the term "paint/stain emulsion" we mean an air dryable coating composition for providing a selected background color for a two-component wood graining process. In its preferred forms, the Step #1 coating will dry quickly, e.g., in from 30 to 90 minutes at 70° F., will spray or brush on smoothly to form a drip free, opaque coating on a vertical surface to a wet thickness of from 3 to 3.5 mm , will be water-based, will have a total solids content of about 38 to 45 weight %, e.g., about 41%, and will have a pigment solids content of about 8–10 weight %, e.g., about 9%. Step #1 coat provides a uniform background color—something difficult to achieve where the first step is a regular stain-type material which tends to be translucent. The Step #1 coat is desirably a self-cross linking acrylic water-based system, e.g., an exterior grade (non yellowing) preferably styrene free latex acrylic. A preferred viscosity for the Step #1 coat will be about 35 to 50 Zahn seconds, using a #3 cup.

A preferred composition for the Step #1 coat will contain 40 to 80% of a self cross linking acrylic, e.g., an exterior grade (non yellowing) preferably styrene free latex acrylic, 2 to 25% pigment (lower amounts of less than 10% are effective), from 0.3 to 0.5% surfactants, 0.4 to 0.8% thickeners, 4 to 10% water, 5 to 8% cosolvents and I to 3% dispersants, these materials being combined and formulated in accord with procedures known to the art. It is necessary that Step #1 possess strong adhesion to the many varieties of substrates to be coated such as: primed steel doors, fiberglass doors, wood doors and composite doors. It must have adhesion to the many types of door glass moldings comprised of acrylic, polyvinyl chloride (PVC), styrene, and more. Furthermore, Step #1 must have outstanding flow and leveling to obtain uniform coverage on the surface of any substrate with a simulated wood grain, or ticks. This coverage ensures adhesion to adequate coating dry mil thickness on the entire surface of the door for: opacity and effective two-step application process, and to ensure longevity, and durability of the coating to the exterior elements.

It is advantageous that the preferred compositions for the Step #2 coat contains urethane/acrylic polymer hybrid, which provides durability, ease of application and sufficient open time for good workability. These coatings due to the acrylic and the pigments used therein have a good surface gloss upon drying and maintain it for extended periods of exposure to the sun and the elements. Compositionally the urethane/acrylic component is of the self cross linking (oxidative cross linking) type, it is preferably of the water reducible type, characterized by chemical resistance to environmental factors, giving it good exterior durability. Compositionally the surfactant component is preferably of the non-silicone type, characterized by a combination of non-ionic and anionic surfactants having defoaming activity. Compositionally the solvent component is preferably of the glycol type, characterized by a low content of hazardous air pollutants. The preferred solvents, some of which are exemplified, have low boiling points and enhance quality film formation. The pigments can be any of those typically used in similar compositions, such as raw umber, burnt umber, raw sienna, titanium dioxide, yellow oxides, black, red oxides, rutile titanium, various blends of these with other colored pigments and dyes.

The Step #1 coat is a pigmented coating formulated in a manner effective to produce a uniform background coloring coating. As noted above, this solves a very significant problem with systems based on transparent or translucent stains as a first coat. It is formulated to have a consistency effective to provide a uniform, thin coating over the surface of application and be of a suitable consistency to be easily spread into grain-defining ticks on the surface of the substrate, without filling the ticks. When applied simply by brushing or spraying in an amount sufficient to uniformly color the substrate, the ticks are still large enough to easily receive and be colored by the Step #2 coat as will be described below. The combined use of a base coat with a graining coat as provided by the invention provides a brilliance and depth of natural wood simulation that is distinctly different than achieved by prior art methods. For this coating to be so weather resistant is surprising for any coating but especially for one so beautiful and easy to apply. The brilliance is attributed to the provision of an opaque background and a very light, transparent but darkening graining coat. The two colors are compatibly selected to provide a natural look of any selected wood type, e.g., oak, maple, cherry, walnut, pine, and the like.

The preferred manner of applying the "Step #2", "grain" coat is to spray it lightly onto the substrate in an amount sufficient to deposit a coloring amount in a majority the grain-defining ticks on the surface of the substrate. To accomplish this, a spray container, e.g., with a finger-operated pump, is used to sparingly mist the substrate coated with the Step #1 coat. The spray is desirably applied at a rate of from about 1 to 3 ounces per 32 square feet of area, preferably at about 1.5 ounces. The Step #2 coat can be smoothed, preferably by dry brushing, and cleared of any excess in a manner effective to deposit a coloring amount in a majority the grain defining ticks on the surface of the substrate. In the less preferred method wherein the grain coat is applied with a brush or cloth, the use of a scraper, brush and/or cloth can be helpful. More or less of the composition can be employed as desired, but the amounts indicated give good results. The spray bottle application provides surprisingly rapid and uniform application with surprisingly little grain coat composition.

In a preferred form the Step #2 is applied sparingly with little excess to be removed, and the surface having the sprayed on Step #2 coating material can be simply dry brushed or rubbed with a cloth to assure applying the contrasting color of the Step #2 coat into the grain-representing ticks. If desired the Step #2 coat can be applied with a dampened cloth or the like. Also, while not preferred, the Step #2 coat can be brushed on and then squeegeed off with a straight edge (e.g., of paper, plastic, rubber or the like) to clean the raised surfaces 16 and move the Step #2 coat into the ticks 12. A preferred viscosity for the Step #2 coat is a semi-gel consistency.

In its preferred forms, the Step #2 coating will set to touch in 1 to 3 hours at 70° F. (depending on humidity), and will dry through in 24 hours. It will spray or brush on easily, will be water-based, will have a total solids content effective for graining, preferably of about 10 to 20 weight %, e.g., about 11–14%, and will have a pigment solids content of about 4 to 12 weight %, e.g., about 10–11%. A preferred composition for the Step #2 coat will contain 10 to 30% of a suitable acrylic, e.g., an alkyd/acrylic(e.g., a 3:1 blend, weight of alkyd paint to weight emulsified acrylic) or a urethane/acrylic, 4 to 25% pigment, from 0.1 to 1% surfactants, 0.1 to 2% thickeners, 4 to 80% water, 1 to 10% solvents and 1 to 3% dispersants, these materials being combined and formulated in accord with procedures known to the art. Preferred ranges are illustrated in the examples, and less preferred formulations will vary those specific values can be modified by up to 50%, or more preferably less than 25% of the indicated amounts.

A preferred form of kit 18 according to the invention is shown in FIG. 3 as comprising: a container 20 of opaque, pigmented, water-based stain (Step #1 coat); a container 22 of pigmented, water-based graining coat emulsion (Step #2 coat) shown in an optional spray bottle, an optional brush 24, an optional cloth 26 and an optional scraper 28. Instructions for applying the two component grain coatings according to the process of the invention can be printed on the box or supplied as a package insert, not shown. An instruction sheet, shown in more detail in FIG. 4, is shown as 30. All can be packaged together in box or the like 32. Also optional can be sticks, e.g., as tongue depressors 34 or the like, gloves 36 and a bottle of wash used to prepare the substrate being worked on.

The following examples are provided to better explain and illustrate the invention but are not to be taken as limiting in any regard. Unless otherwise indicated, all parts and percentages are by weight and are based on the weight of the product or component at the indicated stage in processing.

EXAMPLE 1

A door panel of the type illustrated in FIG. 1, having a surface of polymer sealed fiberglass, is finished according to the invention. A Step #1 (base coat) coating having the following formulation is applied by brushing on the door panel to achieve a non-running, even coat. Approximately 5 to 6 ounces is used to coat one side of a door having a surface area of 32 square feet. This formulation is prepared to simulate oak when used with an appropriately formulated Step #2 (grain coat) coating, but the pigments could be selected complimentarily to simulate other wood types.

Step #1 Coat Formulation

| Ingredient | Parts by Weight |
|---|---|
| Self-Crosslinking Acrylic | 60.45 |
| Amine pH adjuster | 0.11 |
| Water | 5.44 |

-continued

| Ingredient | Parts by Weight |
|---|---|
| Glycol Ether Solvent | 7.12 |
| Associative Thickener | 0.25 |
| Nonionic surfactant | 0.18 |
| Anionic surfactant | 0.26 |
| Defoamer | 0.38 |
| Wax emulsion | 6.49 |
| Yellow Iron Oxide | 2.61 |
| Raw Sienna | 9.64 |
| Raw Umber | 1.16 |
| Titanium Pigment, white | 5.46 |
| Non-Urethane Thickener | 1.47 |
| Total | 100.02 |

Step #1 Coat Properties

| Property | Value |
|---|---|
| Volatiles, weight % | 59.7 |
| Volatiles, volume % | 63.8 |
| Solids, weight % | 40.2 |
| Solids, volume % | 36.1 |
| Density, grams per cc | 9.2 |
| VOC, grams per liter | 182.0 |
| VOC, pounds per gallon | 1.5 |
| Volatile Organic Emissions, grams/liter | 81 |
| Application temperature | 65° F. |

A Step #2 coating having the following formulation is applied by spray bottle to the door panel to achieve a light coating. Approximately 1.5 ounces is used to coat each side of the door. The coating is applied using the following recommended manner:

1. Using the enclosed spray bottle of 'Grain Coat', spray apply the 'Grain Coat' onto the raised panels of the door.
2. Next, using the nearly dry brush—dry brush the 'Grain' coat to spread it evenly and into the 'ticks'.
3. Next, use the flat side of the brush to push the 'grain coat' into the grain by holding it flat and drag it at a 45 degree cross-angle to the grain. This method removes excess grain coat and produces an even look to the part.
4. Brush out the corners and deep recesses—removing excess grain coat.

Wipe the brush dry with the cloth—then use its 'flat side' to tone the recesses.

5. The spray application method enhances the overall effect and finishes the door in rapid fashion.

Note: Use it sparingly—you'll have less to remove!

The door is air dried for 5 hours and gives the appearance of a natural oak wood door.

Step #2 Coat Formulation

| Ingredient | Parts by Weight |
|---|---|
| Water reducible Alkyd | 13.45 |
| Solvent (Texanol) | 1.84 |
| Cobalt Dryer | 0.09 |
| Amine pH adjuster | 0.59 |
| Water | 63.48 |
| Self-Crosslinking Acrylic | 4.24 |
| Diethylene Glycol | 0.58 |

-continued

| Ingredient | Parts by Weight |
|---|---|
| Anionic surfactant | 0.06 |
| Defoamer | 0.03 |
| Wax emulsion | 3.11 |
| Anti skinning agent (OMG-SKINO #2) | 0.23 |
| Propylene Glycol | 3.13 |
| Raw Umber | 1.65 |
| Burnt Umber | 6.00 |
| Yellow Iron Oxide | 1.72 |
| Titanium Pigment, white | 0.73 |
| Total | 100.93 |

Step #2 Coat Properties

| Property | Value |
|---|---|
| Volatiles, weight % | 77.9 |
| Volatiles, volume % | 79.2 |
| Solids, weight % | 22.0 |
| Solids, volume % | 20.7 |
| Density, grams per cc | 8.6 |
| VOC, grams per liter | 274.0 |
| VOC, pounds per gallon | 2.2 |
| Volatile Organic Emissions, grams/liter | 77 |
| Application temperature | 65° F. |

EXAMPLE 2

The Step #1 and Step #2 coating compositions of Example 1 were utilized according to this example to coat a door by a process which varied only in the manner of application of the Step #2 coating. In this case, the Step #2 coating was applied with a brush, applying 4 ounces to the door surface. Then, excess was scraped off with a paper squeegee, the surface was then wiped with a water wetted, damp cotton cloth. The results were essentially the same as those achieved in Example 1.

EXAMPLE 3

A door panel of the type illustrated in FIG. 1, having a surface of polymer sealed fiberglass, is finished according to the invention. A Step #1 coating having the following formulation is applied by brushing on the door panel to achieve a non-running, even coat. Approximately 5 to 6 ounces is used to coat one side of a door having a surface area of 32 square feet. This formulation is prepared to simulate oak when used with an appropriately formulated Step #2 coating, but the pigments could be selected complimentarily to simulate other wood types.

Step #1 Coat Formulation

| Ingredient | Parts by Weight |
|---|---|
| Self-Crosslinking Acrylic | 72.7 |
| Amine pH adjuster | 0.03 |
| Water | 8.4 |
| Dipropylene Glycol Ether Solvent | 3.18 |

-continued

| Ingredient | Parts by Weight |
|---|---|
| Rheological additive | 0.30 |
| Nonionic surfactant | 0.26 |
| Dipropylene Glycol N-Propyl Ether Solvent | 4.77 |
| Defoamer | 0.35 |
| Quinacridone Red | .07 |
| Yellow Iron Oxide | 3.65 |
| Burnt Sienna | 1.97 |
| Burnt Umber | 2.98 |
| Titanium Pigment, white | 1.30 |
| Non-Urethane Thickener | 0.03 |
| Total | 100.00 |

Step #1 Coat Properties

| Property | Value |
|---|---|
| Volatiles, weight % | 64.39 |
| Volatiles, volume % | 67.3 |
| Solids, weight % | 35.6 |
| Solids, volume % | 32.6 |
| Density, grams per cc | 8.8 |
| VOC, grams per liter | 217.1 |
| VOC, pounds per gallon | 1.81 |
| Volatile Organic Emissions, grams/liter | 92 |
| Application temperature | 65° F. |

A Step #2 coating having the following formulation is applied by spray bottle or industrial spray equipment to the door panel to achieve a light coating. Approximately 1.5 ounces is used to coat each side of the door. The light coating is dry brushed with a nylon/polyester blend bristle brush sufficiently to move at least some of the Step #2 coating into the great majority of grain ticks.

Step #2 Coat Formulation

| Ingredient | Parts by Weight |
|---|---|
| Self-Cross linking Urethane/Acrylic | 23.83 |
| Solvent Dipropylene Glycol Normal Butyl Ether | 2.60 |
| Propylene Glycol | 2.72 |
| Water | 61.71 |
| Nonionic surfactant | 0.113 |
| Rheological additive | 1.395 |
| Cellulosic Rheological additive | 0.608 |
| Quinacridone Violet | 2.84 |
| Burnt Umber | 2.89 |
| Quinacridone Red | 0.74 |
| Teraplex Tinting Black | 0.52 |
| Total | 99.966 |

Step #2 Coat Properties

| Property | Value |
|---|---|
| Volatiles, weight % | 86.8 |
| Volatiles, volume % | 89.1 |
| Solids, weight % | 13.1 |
| Solids, volume % | 10.8 |

-continued

| Property | Value |
|---|---|
| Density, grams per cc | 8.6 |
| VOC, grams per liter | 435. |
| VOC, pounds per gallon | 3.6 |
| Material VOC, grams/liter (with water) | 84. |
| Application temperature | 65° F. |

The door is air dried for 3 hours and gives the appearance of a natural oak wood door.

The above description is intended to enable the person skilled in the art to practice the invention. It is not intended to detail all of the possible modifications and variations that will become apparent to the skilled worker upon reading the description. It is intended, however, that all such modifications and variations be included within the scope of the invention that is seen in the above description and otherwise defined by the following claims. The claims are meant to cover the indicated elements and steps in any arrangement or sequence that is effective to meet the objectives intended for the invention, unless the context specifically indicates the contrary.

The invention claimed is:

1. A process for imparting a wood grain and coloration to a textured substrate having a patterned texture surface with recesses therein, consisting of the steps:

applying an opaque, pigmented, water-based emulsion coating composition as a base coat to the substrate;

drying the base coat;

applying a pigmented, water-based urethane/acrylic graining coat in an amount sufficient to provide a darkening graining coat having a complimentary color which together with that of the base coat provides the color of an intended type of wood, spreading the graining coat to color at least a majority of texture recesses in the substrate, while retaining a coating of that graining coat on the texture surface, which together with the base coat color, provides a natural look in terms of grain and coloration of a selected wood type; and drying the graining coat to provide a finished product having a wood grain and coloration.

* * * * *